US010665363B2

(12) United States Patent
Barr

(10) Patent No.: US 10,665,363 B2
(45) Date of Patent: May 26, 2020

(54) LOW DIELECTRIC CONTENT TWIN-AXIAL CABLE CONSTRUCTIONS

(71) Applicant: 3M INNOVATIVE PROPERTIES COMPANY, St. Paul, MN (US)

(72) Inventor: Alexander W. Barr, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/541,265

(22) Filed: Aug. 15, 2019

(65) Prior Publication Data

US 2020/0058417 A1 Feb. 20, 2020

Related U.S. Application Data

(60) Provisional application No. 62/719,374, filed on Aug. 17, 2018.

(51) Int. Cl.
*H01B 7/08* (2006.01)
*H01B 11/18* (2006.01)

(52) U.S. Cl.
CPC ..... *H01B 7/0823* (2013.01); *H01B 11/1891* (2013.01); *H01B 11/1895* (2013.01)

(58) Field of Classification Search
CPC ..... H01B 7/08; H01B 7/0807; H01B 7/0823; H01B 7/0275; H01B 7/184; H01B 11/04; H01B 11/1834
See application file for complete search history.

(56) References Cited

U.S. PATENT DOCUMENTS 5,990,419 A * 11/1999 Bogese, II ..... H01B 7/184 174/113 AS
2009/0229851 A1* 9/2009 Thuot ..... H01B 7/0275 174/107
2009/0229852 A1* 9/2009 Thuot ..... H01B 7/0275 174/113 R
2010/0276178 A1* 11/2010 Keller ..... H01B 7/0275 174/113 C
2012/0285723 A1* 11/2012 Gundel ..... H01B 7/0823 174/113 R
2013/0126209 A1* 5/2013 Heffner ..... H01B 11/06 174/113 R
2015/0348674 A1* 12/2015 Torigoshi ..... H01B 7/0233 174/113 R

* cited by examiner

*Primary Examiner* — Timothy J Thompson
*Assistant Examiner* — Amol H Patel
(74) *Attorney, Agent, or Firm* — Robert S. Moshrefzadeh

(57) ABSTRACT

A ribbon cable with a plurality of spaced apart substantially parallel insulated conductors. The parallel insulated conductors extend along a length of the cable and arranged along a width of the cable. Each insulated conductor has a central conductor surrounded by a structured insulative material formed directly onto the central conductor along substantially the entire length of the cable. The structured insulative material has a plurality of ridges extending from the central conductor along different azimuthal directions. Each pair of adjacent ridges define an angle θ there between greater than about 10 degrees.

19 Claims, 10 Drawing Sheets

LOW DIELECTRIC CONTENT TWIN-AXIAL CABLE CONSTRUCTIONS

TECHNICAL FIELD

The disclosure generally relates to a cable and its construction.

BACKGROUND

Electrical cables for transmission of electrical signals are known. Such electrical cables typically include one or more insulated conductive wires.

SUMMARY

The various embodiments described herein relate to different constructions of ribbon cables with reduced loss and improved reach over solid dielectric constructions while providing precise control of electrical performance and improved resilience to bending According to an aspect of the disclosure a ribbon cable has a plurality of spaced apart substantially parallel insulated conductors. The parallel insulated conductors extend along a length of the cable and is arranged along a width of the cable. Each insulated conductor has a central conductor surrounded by a structured insulative material formed directly onto the central conductor along substantially the entire length of the cable. The structured insulative material has a plurality of ridges extending from the central conductor along different azimuthal directions. Each pair of adjacent ridges defines an angle therebetween greater than about 10 degrees.

In other aspects of the disclosure, a ribbon cable has a plurality of conductor sets. Each conductor set includes a plurality of spaced apart substantially parallel insulated conductors extending along a length of the cable. Each insulated conductor has a central conductor and a plurality of ridges is formed directly on the central conductor extending from the central conductor along different azimuthal directions. A multilayer film substantially surrounds the insulated conductors and has a shield disposed on a substrate. The multilayer film has a plurality of protrusions extending inwardly from the multilayer film. Each protrusion rests on a central conductor of an insulated conductor between adjacent ridges of the insulated conductor. At least one ridge of each insulated conductor makes contact with an inner surface of the multilayer film.

These and other aspects of the present application will be apparent from the detailed description below. In no event, however, should the above summaries be construed as limitations on the claimed subject matter, which subject matter is defined solely by the attached claims.

BRIEF DESCRIPTION OF DRAWINGS

The various aspects of the disclosure will be discussed in greater detail with reference to the accompanying figures where.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION OF ILLUSTRATIVE EMBODIMENTS

Typically, a cable includes one or more insulated conductors, where each insulated conductor includes a central conductor surrounded by a dielectric. Dielectrics are known to reduce the speed of current. The effective dielectric constant of an insulative wire is less than the dielectric constant of the material. Twin-axial platform cables have the ability to provide a specified impedance, controlled signal integrity performance, and low loss in high speed data communication applications. The twin-axial cable has an ability to bend without compromising the impedance of the cable at the bend locations. The cable's ability to maintain its impedance under tight bending allows it to be routed through tight, convoluted paths without the bending creating reflections that would otherwise compromise its transmission performance. The transmission medium inside the cable composed primarily of a polyolefin dielectric insulating the wires along with the polymer adhesive that is used to bond the shield to the wires may introduce higher loss than foamed dielectrics that are a pseudo homogeneous combination of polymer and small cells of air. The foamed dielectrics offer lower loss, particularly at high frequencies, than solid-dielectric constructions. The foamed dielectrics become particularly attractive for classes of applications where the data rate becomes too high to transmit intelligible data over a given distance with solid-dielectric cable, or the reach required at a moderate data rate is beyond a length that can be satisfied by solid dielectric cable, or the packing density of cable pairs within a given cross sectional area cannot be satisfied by a solid-dielectric cable construction.

Foamed dielectric cables typically cannot be bent tightly without the foam collapsing and creating a large impedance discontinuity in the cable. Such a discontinuity creates reflections which then compromise the quality of the received signal at the far end of the cable. Also, it is difficult to control the inclusion of air into the dielectrics of these cables such that the resulting foam exhibits a uniform dielectric constant through-out the cross section as well as the length of the cable. Inability to manage this need can result in imbalance between the two wires in a twin-axial pair resulting in potentially large mode conversion losses in the cable. High mode conversion can result in increased differential insertion loss, interference with effective equalization schemes, and generation of EMI issues from the resulting common mode currents.

Figure 1:
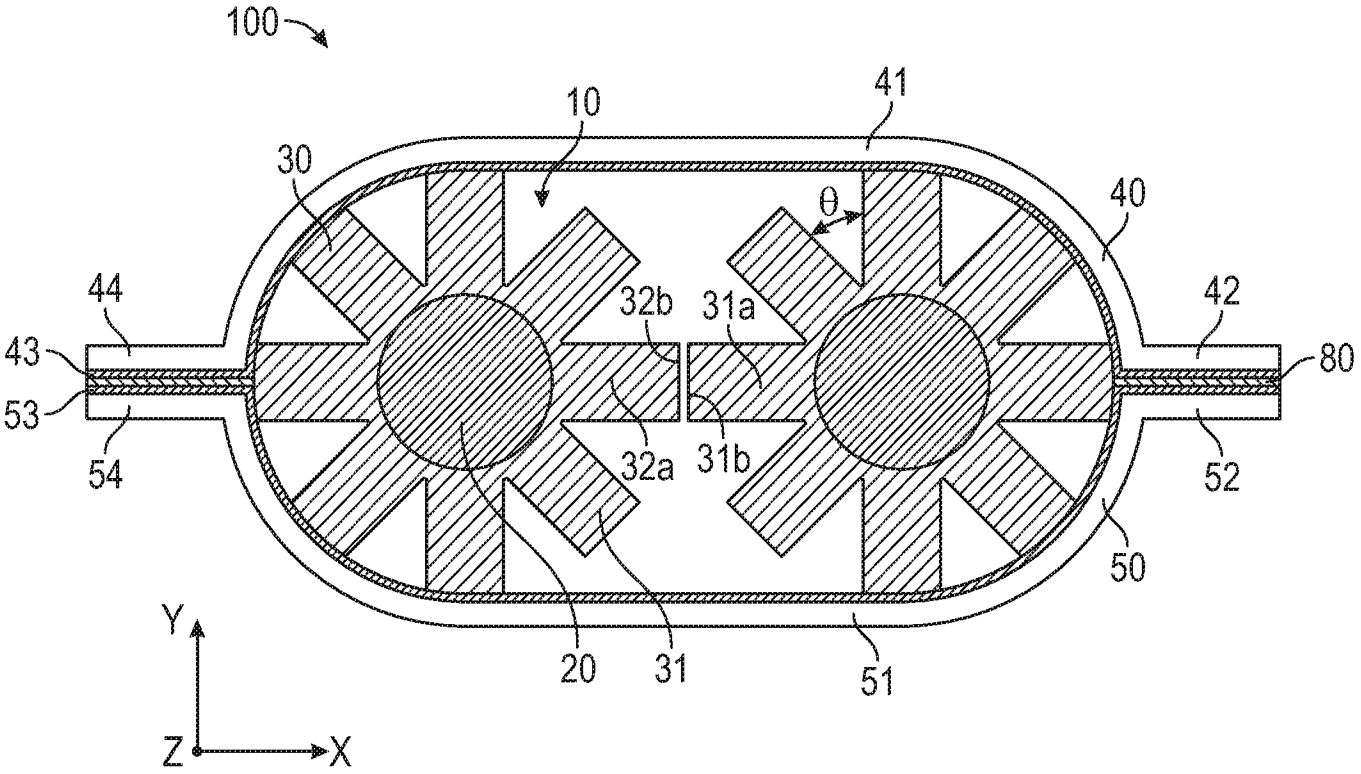
FIG. 1 shows a twin-axial, ribbon cable construction according to an embodiment.

As illustrated in FIG. 1, a ribbon cable (100) includes a plurality of spaced apart substantially parallel insulated conductors (10) extending along a length (z) of the cable and arranged along a width (x) of the cable. Each insulated conductor has a central conductor (20) surrounded by a structured insulative material (30) formed directly onto the central conductor (20) along substantially the entire length of the cable. The structured insulative material includes a plurality of ridges (31) extending from the central conductor along different azimuthal directions. Each pair of the adjacent ridges defines an angle θ therebetween greater than about 10 degrees. In some aspects, the angle θ may be greater than about 20 degrees, In other aspects, the angle θ may be greater than about 30 degrees.

In certain embodiments, the plurality of ridges may include at least three, or five or eight ridges, or more.

Figure 2A:
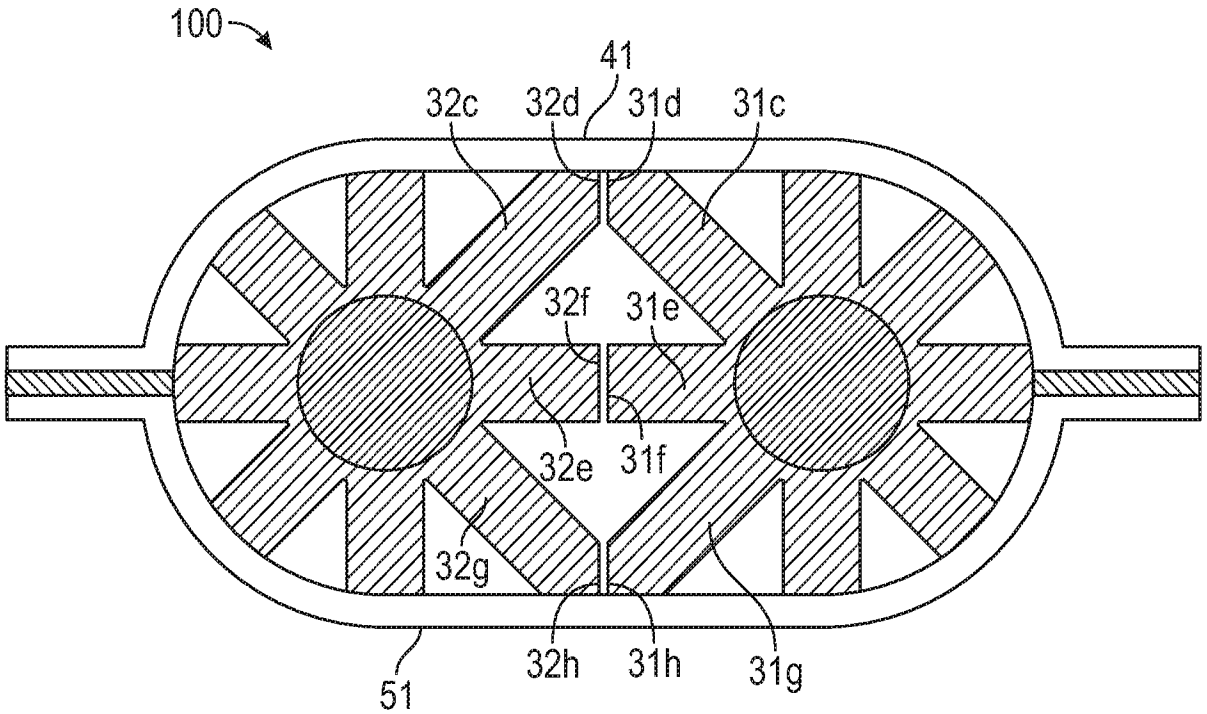
FIGS. 2*a* and 2*b* show different aspects of the ribbon cable construction according to an embodiment.

For each pair of adjacent insulated conductors (10), a ridge (31*a*, 32*a*) of each insulated conductor (10) extends laterally along the width of the cable such that end faces (31*b*, 32*b*) of the two ridges face and contact each other. For instance, as shown in FIG. 1, for each pair of adjacent insulated conductors, an end face (31*b*) of a ridge (31*a*) of one of the insulated conductors faces and contacts an end face (32*b*) of a ridge (32*a*) of the other insulated conductor. In certain aspects as shown best in FIG. 2*a*, for each pair of adjacent insulated conductors, end faces (31*d*, 31*f*, 31*h*) of a plurality of ridges (31*c*, 31*e*, 31*g*) of one of the insulated conductors face and contact corresponding end faces (32*d*, 32*f*, 32*h*) of a plurality of ridges (32*c*, 32*e*, 32*g*) of the other insulated conductor. The ridges (31*c*, 32*c*; 31*g*, 32*g*) angularly protruding from each conductor toward the cover portions (41, 51) at the center of the ribbon cable (100) are extruded longer to reach the inside surface of the cover portions (41, 51) while simultaneously contacting each other. This arrangement ensures that the conductors maintain spacing as well as resisting crushing or kinking during tight bending or folding of the cable (100).

Figure 2B:
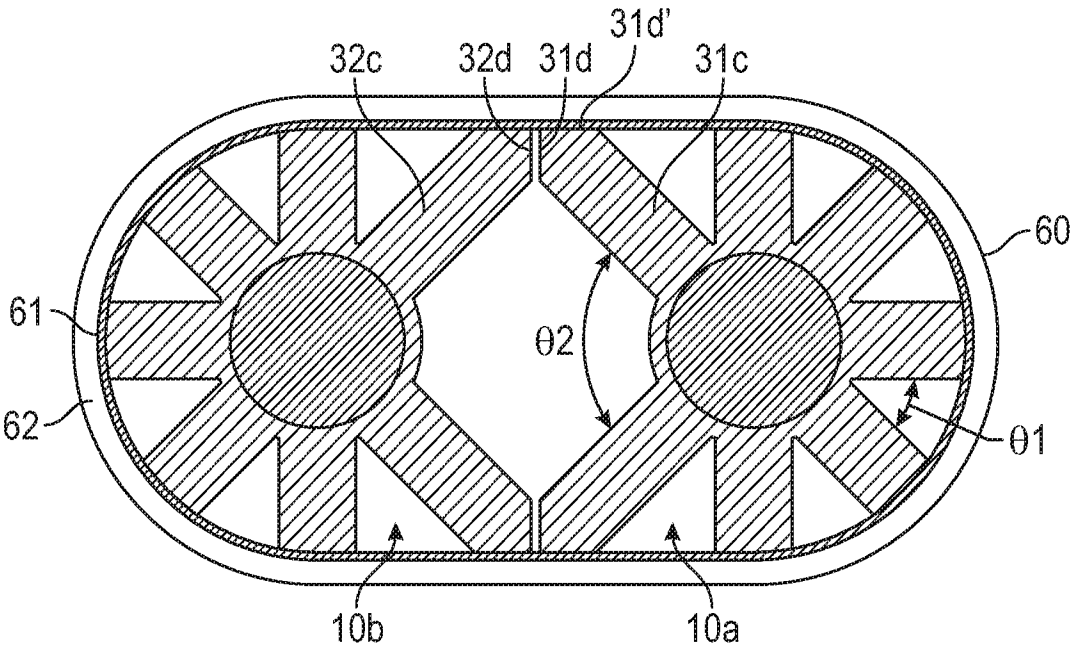

In certain other aspects, for example as shown in FIG. 2*b*, the ridges that extend laterally between the conductors along the width of the cable are removed. Such a construction provides higher air content for lower loss.

The ribbon cable as shown in FIG. 1 further includes first (40) and second (50) multilayer films disposed on respective top and bottom sides of the ribbon cable. The multilayer films (40, 50) include cover portions (41, 51) and pinched portions (42, 52) arranged such that, in cross-section, the cover portions (41, 51) of the first and second films (40, 50), in combination, substantially surround the plurality of the spaced apart substantially parallel insulated conductors (10), and the pinched portions (42, 52) of the first and second films (40, 50), in combination, form pinched portions of the ribbon cable on at least one side of the ribbon cable. In certain embodiments, the first and second multilayer films (40, 50) include an electrically conductive shield layer (43, 53) disposed on an electrically insulative support layer (44, 54). An adhesive layer (80) bonds the first and second multilayer films (40, 50) to each other in the pinched portions (42, 52) of the ribbon cable.

In certain embodiments as shown in FIG. 2*b*, a multilayer film (60) surrounds the plurality of spaced apart substantially parallel insulated conductors (10*a*, 10*b*). The multilayer film (60) includes an electrically conductive shield layer (61) disposed on an electrically insulative support layer (62). For at least one ridge (31*c*) of at least one insulated conductor (10*a*), the ridge has an end face having a first end portion (31*d*) facing and making contact with an end face (32*d*) of a ridge (32*c*) of an adjacent insulated conductor (10*b*), and a second end portion (31*d'*) facing and making contact with the film (60). As illustrated in FIG. 2*b*, the angle θ1 defined between one pair of adjacent ridges is different than the angle θ2 defined by another pair of adjacent ridges.

Figure 3:
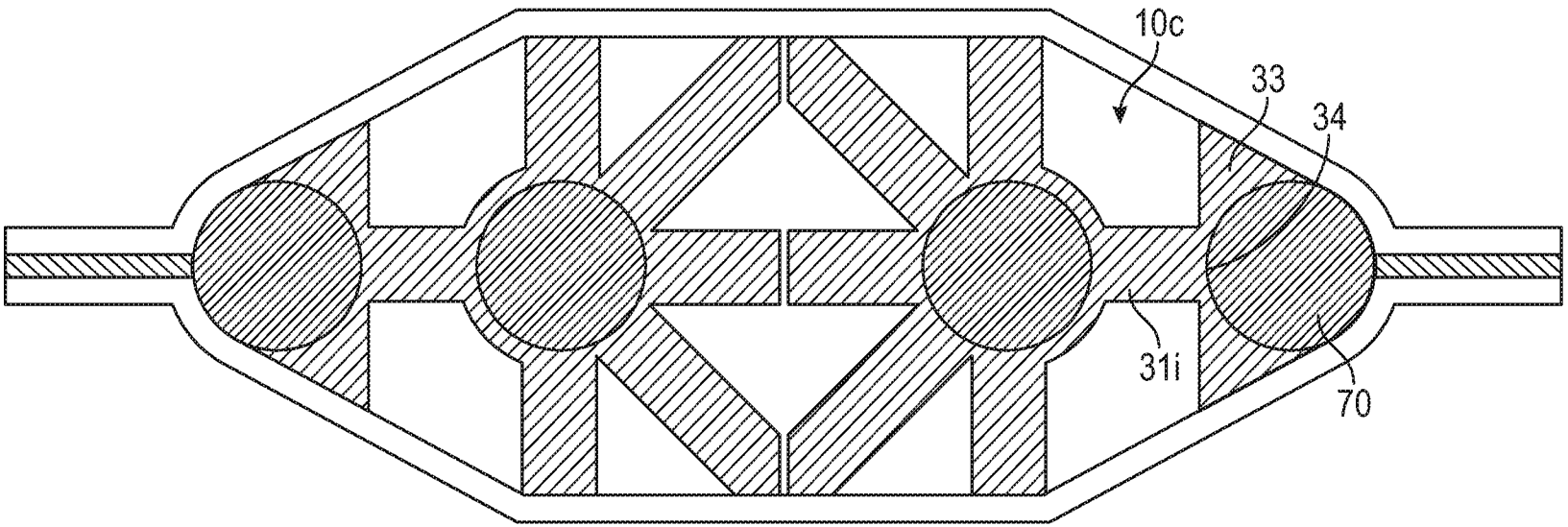
FIG. 3 shows a differential pair ribbon cable with drain wires included within the pair, FIG. 4 show different embodiments of the ribbon cable with micro-replication features.

In some aspects as best shown in FIG. 3, a ridge (31*i*) of at least one insulated conductor (10*c*) has an end portion (33) defining a recess (34) therein. The ribbon cable includes an electrically uninsulated drain wire (70) disposed at least partially within the recess (34). The recess (34) helps to capture and position the drain wire (70) in the cable.

Figure 4:
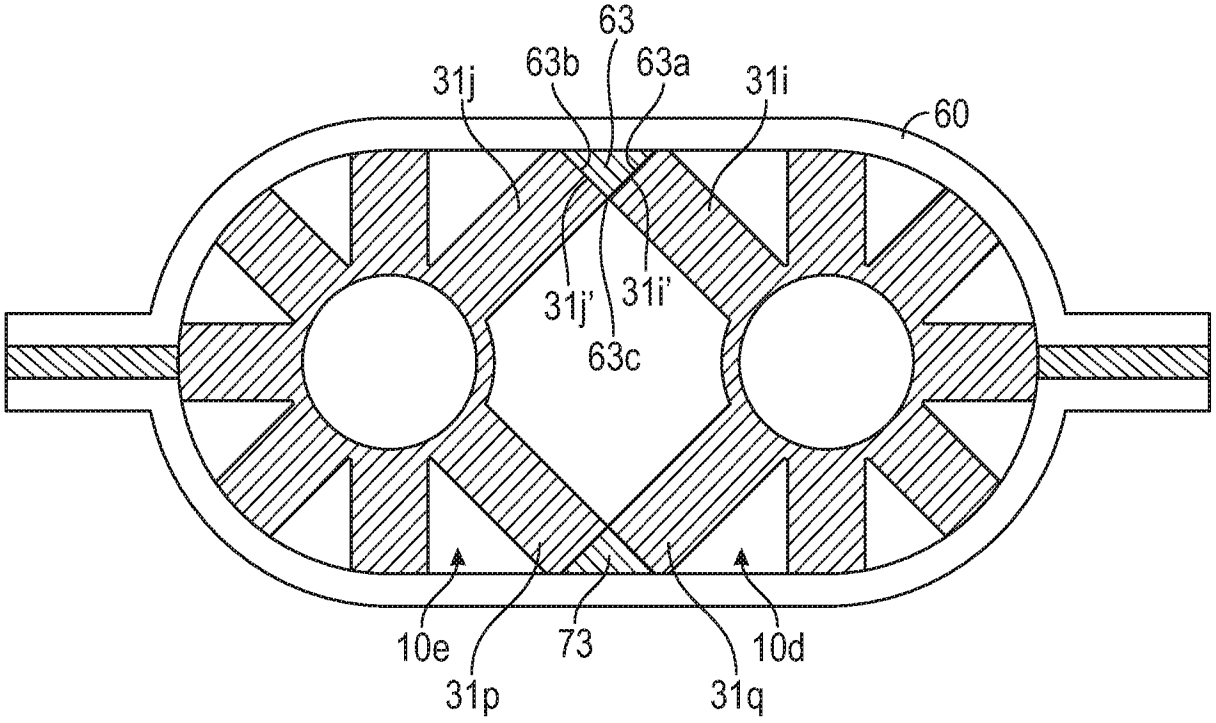

In an embodiment as shown in FIG. 4, the multilayer film (60) at least partially surrounds the plurality of spaced apart substantially parallel insulated conductors. The film (60) includes a protrusion (63) extending inwardly from the film (60) and engaging a ridge (31*i*, 31*j*) of each of two adjacent insulated conductors (10*d*, 10*e*). In certain aspects, the film (60) includes opposing protrusions (63, 73) extending inwardly from the film (60) toward each other and engaging a ridge (31*i*, 31*j*; 31*p*, 31*q*) of each of two adjacent insulated conductors (10*d*, 10*e*). The protrusion (63) includes opposing first (63*a*) and second (63*b*) surfaces meeting a peak (63*c*). The first surface (63*a*) faces and makes contact with an end face (31*i'*) of the ridge of one of the two adjacent insulated conductors. The second surface (63*b*) faces and makes contact with an end face (31*j'*) of the ridge of the other one of the two adjacent insulated conductors. The protrusion (63, 64) according to this embodiment may be a triangular micro-replicated feature included in the inner surface of the film. In some embodiments, the micro-replicated protrusion may be constructed so that all the ridges of the insulators are of identical length for balance in extrusion.

Figure 7:
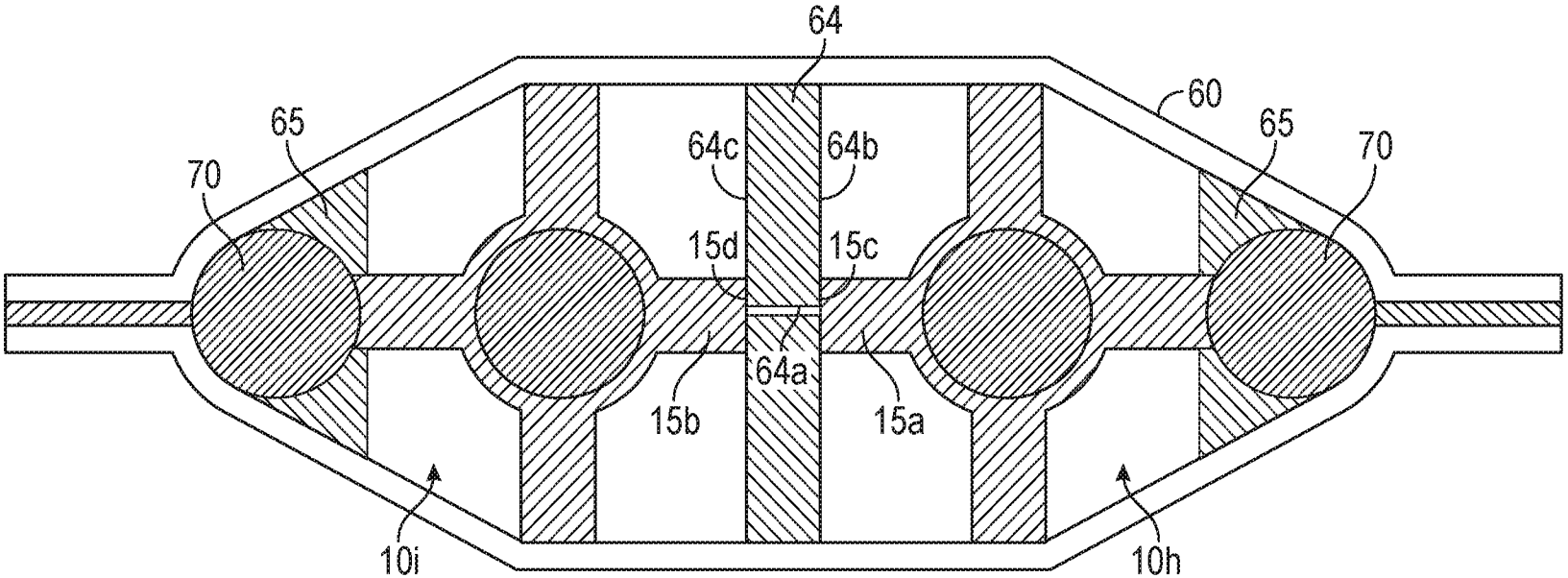
FIG. 7 shows an embodiment of the ribbon cable construction that includes insulators along with micro-replication features to retain both drain wires and to support in the center of the cable.

In certain embodiments as best shown in FIG. 7, each insulated conductor (10*h*, 10*i*) is extruded with four ridges. The ridges are oriented vertically and horizontally in the cable so that the spacing of the film and separation to the drain wires (70) is maintained. The film (60) includes a protrusion (64). The protrusion (64) extends inwardly from the film and has an end face (64*a*) connecting opposing side surfaces (64*b*, 64*c*). Each side surface faces and makes contact with an end face (15*c*, 15*d*) of a ridge (15*a*, 15*b*) of each of two adjacent insulated conductors (10*h*, 10*i*). The protrusion (64) is included in the film (60) to support the separation of the middle portion of the top and bottom portions of the film (60) as well as to set a spacing between the conductors. In addition, plurality of protrusions (65) are provided on the film surface to hold the drain wires (70) in position and against the film to maintain DC grounding. Adhesive may be included on the inside surface of the film (60) in between the various micro-replicated features for typical bonding of the cable.

Figure 5:
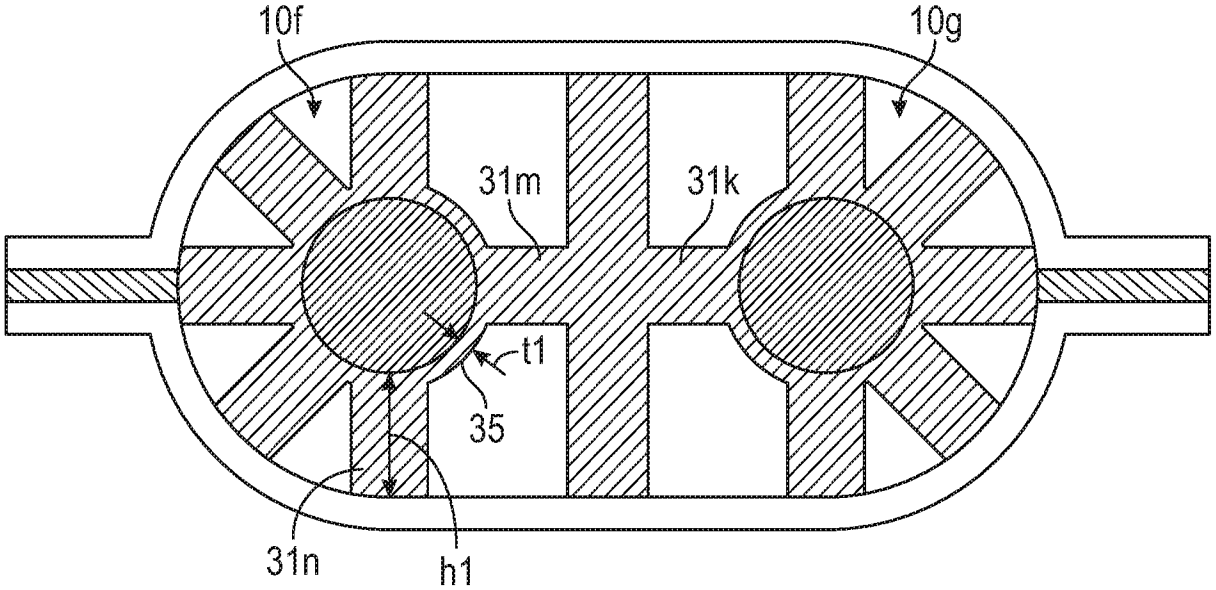
FIG. 5 shows a ribbon cable construction according to an embodiment with insulators that are simultaneously co-extruded around both conductors.

According to the aspect illustrated in FIG. 5, insulation around multiple conductors is co-extruded simultaneously. Multiple ridges exist around each conductor to maintain film spacing along with cross member ridges in the middle of the ribbon cable to maintain spacing between the conductors and between the top and bottom cover portions. For at least one pair of adjacent insulated conductors (10*f*, 10*g*), a ridge (31*k*) of one of the insulated conductors is integrally formed with a ridge (31*m*) of the other insulated conductor. The ribbon cable according to FIG. 5 may be bonded at the ends or adhesive could be included on the inside surface of the film. At least two adjacent ridges (31*m*, 31*n*) of at least one insulated conductor (10*f*) define a land portion (35) there between. The land portion covers and conforms to the central conductor of the at least one insulated conductor. In certain aspects, the land portion (35) has an average thickness t1, and an average height h1 of at least one of the two adjacent ridges defining the land portion, where h1/t1>5. In some cases, h1/t1>10, or h1/t1>20.

Figure 6:
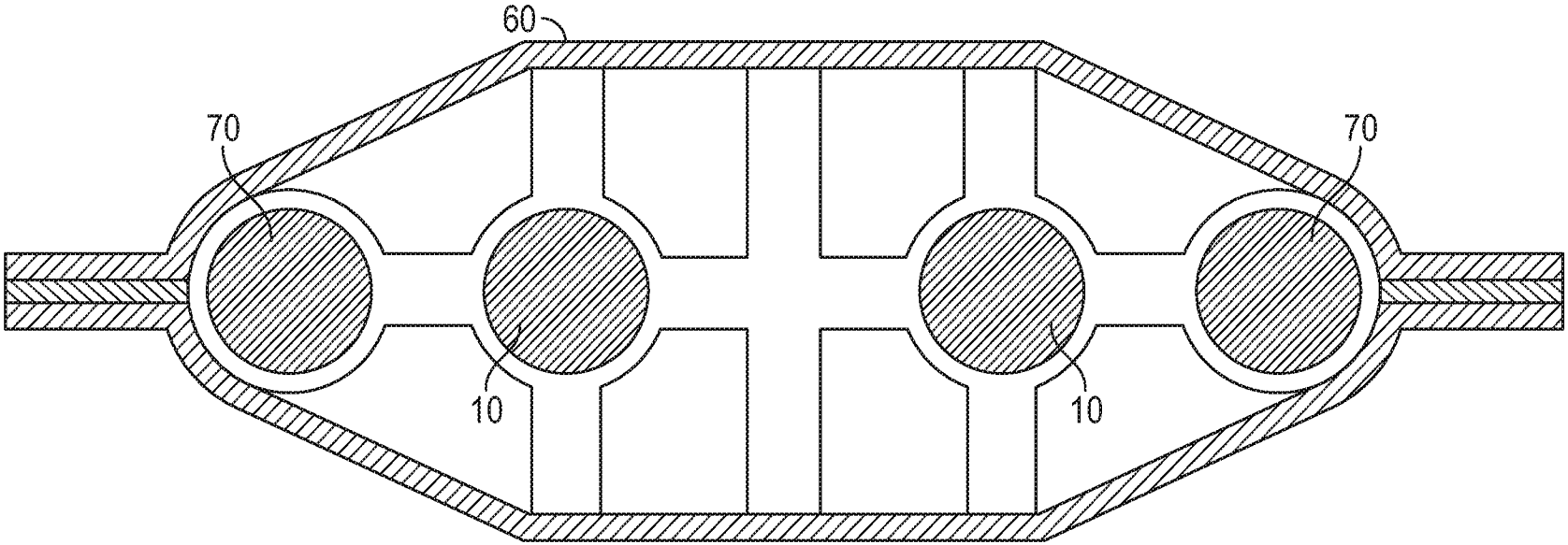
FIG. 6 shows co-extruded set of four conductors (2 signals and 2 drains) according to another aspect of the disclosure.

FIG. 6 shows an embodiment where uninsulated drain wires (70) are also co-extruded with the signal wires. The set of four wires can then be handled as one component during the lamination of the film (60) to the wires. The film (60) will be AC grounded through the capacitance across the insulation surrounding the drain wires (70).

Figure 9:
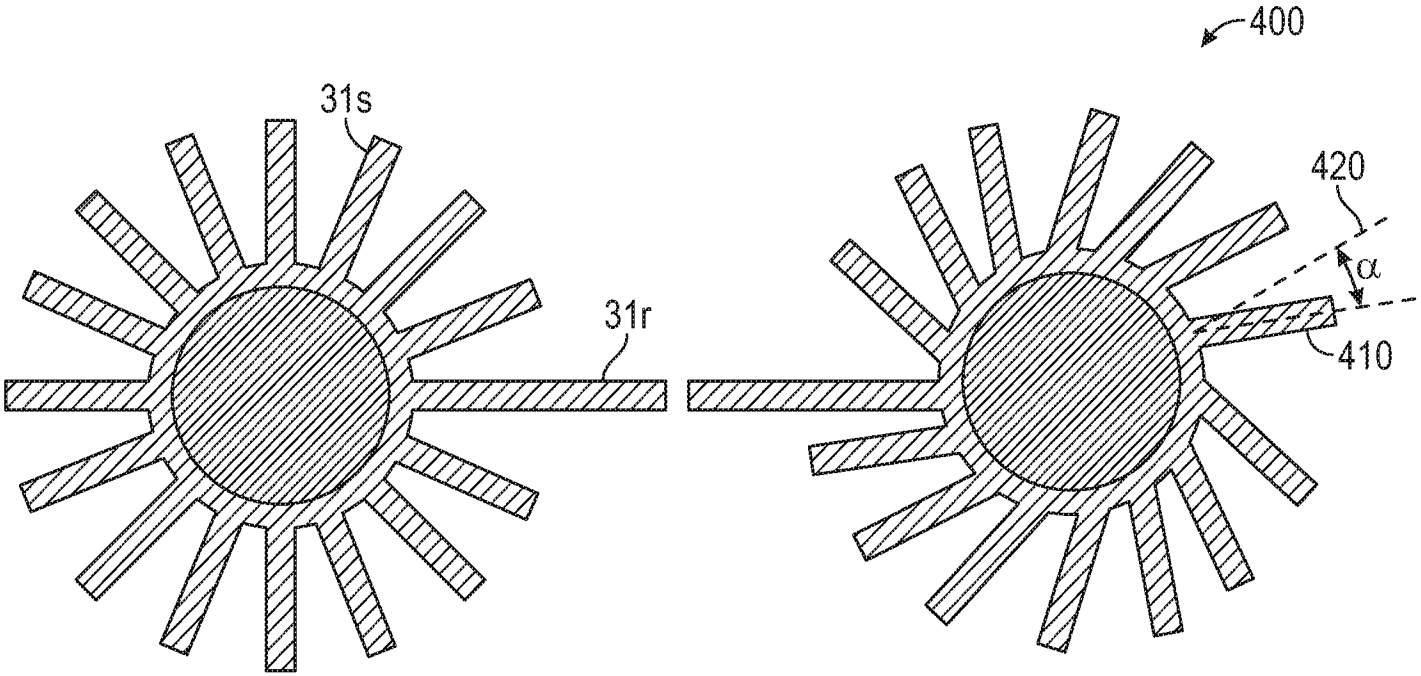
FIG. 9 shows another embodiment of the ribbon cable construction.

In as aspect as shown in FIG. 9, at least one ridge (31*r*) in the plurality of ridges is taller than at least one other ridge (31*s*) in the plurality of ridges. In another aspect, for at least one ridge (410) of at least one insulated conductor (400), the ridge is tilted laterally so that the ridge makes an angle $\alpha$ with a line (420) normal to the conductor at the ridge. The angle $\alpha$ may be greater than about 5 degrees. In some cases, the angle $\alpha$ may be greater than about 10 degrees.

Figure 8:
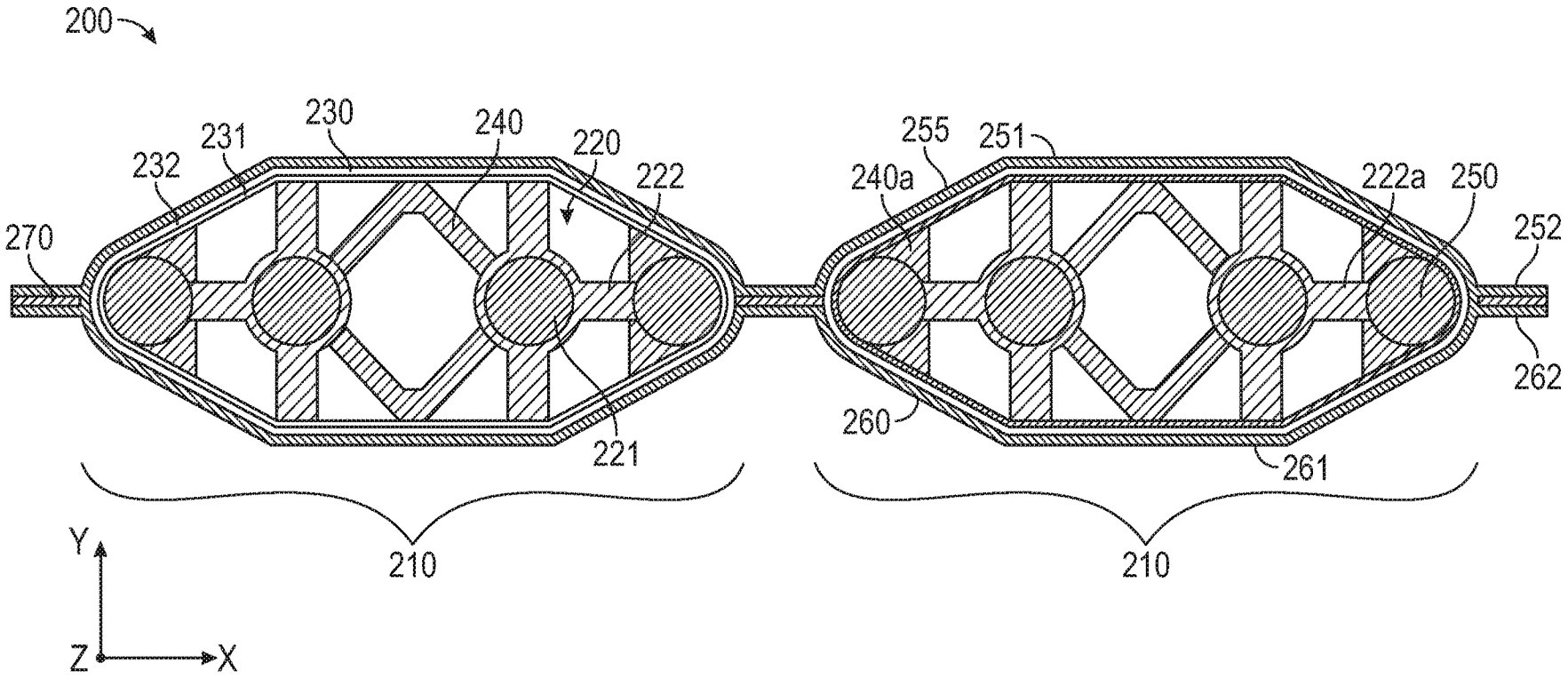
FIG. 8 shows another embodiment of the ribbon cable including plurality of conductor sets with micro replication features.

According to another embodiment as shown in FIG. 8, the ribbon cable (200) includes a plurality of conductor sets (210). Each conductor set has a plurality of spaced apart substantially parallel insulated conductors (220) extending along a length (z) of the cable. Each insulated conductor has a central conductor (221); and a plurality of ridges (222) is formed directly on the central conductor (221) extending from the central conductor (221) along different azimuthal directions. A multilayer film (230) substantially surrounds the insulated conductors (220). The film (230) includes a shield (231) disposed on a substrate (232) and a plurality of protrusions (240) extends inwardly from the multilayer film (230). Each protrusion (240) rests on a central conductor (221) of an insulated conductor (220) between adjacent ridges of the insulated conductor. At least one ridge of each insulated conductor (220) makes contact with an inner surface of the multilayer film (230). Each conductor set may also include an uninsulated drain wire (250). A ridge (222*a*) of an insulated conductor (220) adjacent the drain wire (250) makes contact with the uninsulated drain wire (250). In certain embodiments, the protrusion (240*a*) of the multilayer film (230) of the conductor sets makes contact with the uninsulated drain wire (250).

The ribbon cable according to an aspect includes first (255) and second (260) cover films disposed on opposite sides of the plurality of conductor sets. The first and second cover films (255, 260) include cover portions (251, 261) and pinched portions (252, 262) arranged such that, in cross-section, the cover portions of the first and second cover films (255, 260), in combination, substantially surround each conductor set. The pinched portions (252, 262) of the first and second cover films (255, 260), in combination, form pinched portions of the ribbon cable on at least one side of the ribbon cable (200).

In certain aspects, the pinched portions of the first and second cover films (255, 260), in combination, form pinched portions of the ribbon cable (200) on each side of each conductor set (210). An adhesive layer (270) may bond the first and second cover films (255, 260) to each other in the pinched portions (252, 262) of the ribbon cable (200).

Various aspects/embodiments shown in this disclosure show two separate shields that are bonded together. Each of these concepts may be extended to a cable that has an individual shield wrapped around the entire construction and is bonded together at only one end. In addition, it has been mentioned periodically that illustration of adhesive present on the surfaces of the shields inside the pair has been omitted for ease of illustration. The same adhesive coated shield construction may be leveraged in many forms to aid in stably bonding any of these designs.

Embodiments disclosed herein include:

Embodiment 1

A ribbon cable having a plurality of spaced apart substantially parallel insulated conductors extending along a length of the cable and arranged along a width of the cable, each insulated conductor having a central conductor surrounded by a structured insulative material formed directly onto the central conductor along substantially the entire length of the cable, the structured insulative material having a plurality of ridges extending from the central conductor along different azimuthal directions, each pair of adjacent ridges defining an angle $\theta$ therebetween greater than about 10 degrees.

Embodiment 2

The ribbon cable of embodiment 1, wherein for each pair of adjacent insulated conductors, a ridge of each insulated conductor extends laterally along the width of the cable such than end faces of the two ridges face and contact each other.

Embodiment 3

The ribbon cable of embodiment 1 further having first and second multilayer films disposed on respective top and bottom sides of the ribbon cable and including cover portions and pinched portions arranged such that, in cross-section, the cover portions of the first and second films, in combination, substantially surround the plurality of the spaced apart substantially parallel insulated conductors, and the pinched portions of the first and second films, in combination, form pinched portions of the ribbon cable on at least one side of the ribbon cable.

Embodiment 4

The ribbon cable of embodiment 3, wherein each of the first and second multilayer films includes an electrically conductive shield layer disposed on an electrically insulative support layer.

Embodiment 5

The ribbon cable of embodiment 3 further having an adhesive layer bonding the first and second multilayer films to each other in the pinched portions of the ribbon cable.

Embodiment 6

The ribbon cable of embodiment 1 further having a multilayer film surrounding the plurality of the spaced apart substantially parallel insulated conductors.

Embodiment 7

The ribbon cable of embodiment 6, wherein the multilayer film includes an electrically conductive shield layer disposed on an electrically insulative support layer.

Embodiment 8

The ribbon cable of embodiment 1, wherein for each pair of adjacent insulated conductors, an end face of a ridge of one of the insulated conductors faces and contacts an end face of a ridge of the other insulated conductor.

Embodiment 9

The ribbon cable of embodiment 1, wherein for each pair of adjacent insulated conductors, end faces of a plurality of ridges of one of the insulated conductors face and contact corresponding end faces of a plurality of ridges of the other insulated conductor.

Embodiment 10

The ribbon cable or embodiment 1 further having a film disposed on the plurality of spaced apart substantially parallel insulated conductors, wherein for at least one ridge of at least one insulated conductor, the ridge has an end face having a first end portion facing and making contact with an end face of a ridge of an adjacent insulated conductor, and a second end portion facing and making contact with the film.

Embodiment 11

The ribbon cable of embodiment 1, wherein the angle θ1 defined between one pair of adjacent ridges is different than the angle θ2 defined between another pair of adjacent ridges.

Embodiment 12

The ribbon cable of embodiment 1, wherein a ridge of at least one insulated conductor includes an end portion defining a recess therein, and wherein the ribbon cable includes an electrically uninsulated drain wire disposed at least partially within the recess.

Embodiment 13

The ribbon cable of embodiment 1 further having a film disposed on and at least partially surrounding the plurality of spaced apart substantially parallel insulated conductors, the film having a protrusion extending inwardly from the film and engaging a ridge of each of two adjacent insulated conductors.

Embodiment 14

The ribbon cable of embodiment 13, wherein the protrusion includes opposing first and second surfaces meeting a peak, the first surface facing and making contact with an end face of the ridge of one of the two adjacent insulated conductors, the second surface facing and making contact with an end face of the ridge of the other one of the two adjacent insulated conductors.

Embodiment 15

The ribbon cable of embodiment 1, wherein for at least one pair of adjacent insulated conductors, a ridge of one of the insulated conductors is integrally formed with a ridge of the other insulated conductor.

Embodiment 16

The ribbon cable of embodiment 1, wherein at least two adjacent ridges of at least one insulated conductor define a land portion therebetween, the land portion covering and conforming to the central conductor of the at least one insulated conductor.

Embodiment 17

The ribbon cable of embodiment 16, wherein the land portion has an average thickness t1, and an average height of at least one of the two adjacent ridges defining the land portion is h1, $h1/t1>5$.

Embodiment 18

The ribbon cable of embodiment 17, wherein $h1/t1>10$.

Embodiment 19

The ribbon cable of embodiment 17, wherein $h1/t1>20$.

Embodiment 20

The ribbon cable of embodiment 1 further having a film surrounding the plurality of spaced apart substantially parallel insulated conductors, the film having opposing protrusions extending inwardly from the film toward each other and engaging a ridge of each of two adjacent insulated conductors.

Embodiment 21

The ribbon cable of embodiment 1 further having a film disposed on and at least partially surrounding the plurality of spaced apart substantially parallel insulated conductors, the film having a protrusion extending inwardly from the film and having an end face connecting opposing side surfaces, each side surface facing and making contact with an end face of a ridge of each of two adjacent insulated conductors.

Embodiment 22

The ribbon cable of embodiment 1, wherein the angle θ is greater than about 20 degrees.

Embodiment 23

The ribbon cable of embodiment 1, wherein the angle θ is greater than about 30 degrees.

Embodiment 24

The ribbon cable of embodiment 1, wherein the plurality of ridges has at least three ridges.

Embodiment 25

The ribbon cable of embodiment 1, wherein the plurality of ridges has at least five ridges.

Embodiment 26

The ribbon cable of embodiment 1, wherein the plurality of ridges has at least eight ridges.

Embodiment 27

The ribbon cable of embodiment 1, wherein the plurality of ridges has at least eight ridges.

Embodiment 28

The ribbon cable of embodiment 1, wherein at least one ridge in the plurality of ridges is taller than at least one other ridge in the plurality of ridges.

Embodiment 29

The ribbon cable of embodiment 1, wherein for at least one ridge of at least one insulated conductor, the ridge is tilted laterally so that the ridge makes an angle θ with a line normal to the conductor at the ridge, the angle θ greater than about 5 degrees.

Embodiment 30

The ribbon cable of embodiment 29, wherein θ is greater than about 10 degrees.

Embodiment 31

A ribbon cable having: a plurality of conductor sets, each conductor set having: a plurality of spaced apart substantially parallel insulated conductors extending along a length of the cable, each insulated conductor having: a central conductor; and a plurality of ridges formed directly on the central conductor and extending from the central conductor along different azimuthal directions; a multilayer film substantially surrounding the insulated conductors having a shield disposed on a substrate, the multilayer film having a plurality of protrusions extending inwardly from the multilayer film, each protrusion resting on a central conductor of an insulated conductor between adjacent ridges of the insulated conductor, at least one ridge of each insulated conductor making contact with an inner surface of the multilayer film.

Embodiment 32

The ribbon cable of embodiment 31, wherein each conductor set further includes an uninsulated drain wire, and wherein a ridge of an insulated conductor adjacent the drain wire makes contact with the uninsulated drain wire.

Embodiment 33

The ribbon cable of embodiment 32, wherein a protrusion of the multilayer film of the conductor sets makes contact with the uninsulated drain wire.

Embodiment 34

The ribbon cable of embodiment 31 further having first and second cover films disposed on opposite sides of the plurality of conductor sets and including cover portions and pinched portions arranged such that, in cross-section, the cover portions of the first and second cover films, in combination, substantially surround each conductor set, and the pinched portions of the first and second cover films, in combination, form pinched portions of the ribbon cable on at least one side of the ribbon cable.

Embodiment 35

The ribbon cable of embodiment 34, wherein the pinched portions of the first and second cover films, in combination, form pinched portions of the ribbon cable on each side of each conductor set.

Embodiment 36

The ribbon cable of embodiment 34 further having an adhesive layer bonding the first and second cover films to each other in the pinched portions of the ribbon cable.

Descriptions for elements in figures should be understood to apply equally to corresponding elements in other figures, unless indicated otherwise. Although specific Embodiments have been illustrated and described herein, it will be appreciated by those of ordinary skill in the art that a variety of alternate and/or equivalent implementations can be substituted for the specific Embodiments shown and described without departing from the scope of the present disclosure. This application is intended to cover any adaptations or variations of the specific Embodiments discussed herein. Therefore, it is intended that this disclosure be limited only by the claims and the equivalents thereof.

The invention claimed is:

1. A ribbon cable comprising a plurality of spaced apart substantially parallel insulated conductors extending along a length of the cable and arranged along a width of the cable, each insulated conductor comprising a central conductor surrounded by a structured insulative material formed directly onto the central conductor along substantially the entire length of the cable, the structured insulative material comprising a plurality of ridges extending from the central conductor along different azimuthal directions, each pair of adjacent ridges defining an angle θ therebetween greater than about 10 degrees, wherein a ridge of at least one insulated conductor comprises an end portion defining a recess therein, and wherein the ribbon cable comprises an electrically uninstalled drain wire disposed at least partially within the recess.

2. The ribbon cable of claim 1, wherein for each pair of adjacent insulated conductors, a ridge of each insulated conductor extends laterally along the width of the cable such than end faces of the two ridges face and contact each other.

3. The ribbon cable of claim 1 further comprising first and second multilayer films disposed on respective top and bottom sides of the ribbon cable and including cover portions and pinched portions arranged such that, in cross-section, the cover portions of the first and second films, in combination, substantially surround the plurality of the spaced apart substantially parallel insulated conductors, and the pinched portions of the first and second films, in combination, form pinched portions of the ribbon cable on at least one side of the ribbon cable.

4. The ribbon cable of claim 3, wherein each of the first and second multilayer films comprises an electrically conductive shield layer disposed on an electrically insulative support layer.

5. The ribbon cable of claim 1 further comprising a multilayer film surrounding the plurality of the spaced apart substantially parallel insulated conductors, wherein the multilayer film comprises an electrically conductive shield layer disposed on an electrically insulative support layer.

6. The ribbon cable of claim 1, wherein for each pair of adjacent insulated conductors, an end face of a ridge of one of the insulated conductors faces and contacts an end face of a ridge of the other insulated conductor.

7. The ribbon cable of claim 1, wherein for each pair of adjacent insulated conductors, end faces of a plurality of ridges of one of the insulated conductors face and contact corresponding end faces of a plurality of ridges of the other insulated conductor.

8. The ribbon cable or claim 1 further comprising a film disposed on the plurality of spaced apart substantially parallel insulated conductors, wherein for at least one ridge of at least one insulated conductor, the ridge has an end face comprising a first end portion facing and making contact with an end face of a ridge of an adjacent insulated conductor and a second end portion facing and making contact with the film.

9. The ribbon cable of claim 1, wherein the angle θ1 defined between one pair of adjacent ridges is different than the angle θ2 defined between another pair of adjacent ridges.

10. The ribbon cable of claim 1, wherein at least two adjacent ridges of at least one insulated conductor define a land portion there between, the land portion covering and conforming to the central conductor of the at least one insulated conductor, wherein the land portion has an average thickness t1, and an average height of at least one of the two adjacent ridges defining the land portion is h1, h1/t1>5.

11. The ribbon cable of claim 1, wherein at least one ridge in the plurality of ridges is taller than at least one other ridge in the plurality of ridges, and wherein for at least one ridge of at least one insulated conductor, the ridge is tilted laterally so that the ridge makes an angle θ with a line normal to the conductor at the ridge, the angle a greater than about 5 degrees.

12. A ribbon cable comprising a plurality of spaced apart substantially parallel insulated conductors extending along a length of the cable and arranged along a width of the cable, each insulated conductor comprising a central conductor surrounded by a structured insulative material formed directly onto the central conductor along substantially the entire length of the cable, the structured insulative material comprising a plurality of ridges extending from the central conductor along different azimuthal directions, each pair of adjacent ridges defining an angle θ therebetween greater than about 10 degrees, wherein the cable further comprises a film disposed on and at least partially surrounding the plurality of spaced apart substantially parallel insulated conductors, the film comprising a protrusion extending inwardly from the film and engaging a ridge of each of two adjacent insulated conductors.

13. The ribbon cable of claim 12, wherein the protrusion comprises opposing first and second surfaces meeting a peak, the first surface facing and making contact with an end face of the ridge of one of the two adjacent insulated conductors, the second surface facing and making contact with an end face of the ridge of the other one of the two adjacent insulated conductors.

14. A ribbon cable comprising a plurality of spaced apart substantially parallel insulated conductors extending along a length of the cable and arranged along a width of the cable, each insulated conductor comprising a central conductor surrounded by a structured insulative material formed directly onto the central conductor along substantially the entire length of the cable, the structured insulative material comprising a plurality of ridges extending from the central conductor along different azimuthal directions, each pair of adjacent ridges defining an angle θ therebetween greater than about 10 degrees, wherein for at least one pair of adjacent insulated conductors, a ridge of one of the insulated conductors is integrally formed with a ridge of the other insulated conductor.

15. A ribbon cable comprising a plurality of spaced apart substantially parallel insulated conductors extending along a length of the cable and arranged along a width of the cable, each insulated conductor comprising a central conductor surrounded by a structured insulative material formed directly onto the central conductor along substantially the entire length of the cable, the structured insulative material comprising a plurality of ridges extending from the central conductor along different azimuthal directions, each pair of adjacent ridges defining an angle θ therebetween greater than about 10 degrees, wherein the ribbon cable further comprises a film surrounding the plurality of spaced apart substantially parallel insulated conductors, the film comprising opposing protrusions extending inwardly from the film toward each other and engaging a ridge of each of two adjacent insulated conductors.

16. A ribbon cable comprising a plurality of spaced apart substantially parallel insulated conductors extending along a length of the cable and arranged along a width of the cable, each insulated conductor comprising a central conductor surrounded by a structured insulative material formed directly onto the central conductor along substantially the entire length of the cable, the structured insulative material comprising a plurality of ridges extending from the central conductor along different azimuthal directions, each pair of adjacent ridges defining an angle θ therebetween greater than about 10 degrees, wherein the ribbon cable further comprises a film disposed on and at least partially surrounding the plurality of spaced apart substantially parallel insulated conductors, the film comprising a protrusion extending inwardly from the film and comprising an end face connecting opposing side surfaces, each side surface facing and making contact with an end face of a ridge of each of two adjacent insulated conductors.

17. A ribbon cable comprising:

a plurality of conductor sets, each conductor set comprising:

a plurality of spaced apart substantially parallel insulated conductors extending along a length of the cable, each insulated conductor comprising:

a central conductor; and a plurality of ridges formed directly on the central conductor and extending from the central conductor along different azimuthal directions;

a multilayer film substantially surrounding the insulated conductors comprising a shield disposed on a substrate, the multilayer film comprising a plurality of protrusions extending inwardly from the multilayer film, each protrusion resting on a central conductor of an insulated conductor between adjacent ridges of the insulated conductor, at least one ridge of each insulated conductor making contact with an inner surface of the multilayer film.

18. The ribbon cable of claim 17, wherein each conductor set further comprises an uninsulated drain wire, and wherein a ridge of an insulated conductor adjacent the drain wire makes contact with the uninsulated drain wire, and wherein a protrusion of the multilayer film of the conductor sets makes contact with the uninsulated drain wire.

19. The ribbon cable of claim 17 further comprising first and second cover films disposed on opposite sides of the plurality of conductor sets and including cover portions and pinched portions arranged such that, in cross-section, the cover portions of the first and second cover films, in combination, substantially surround each conductor set, and the pinched portions of the first and second cover films, in combination, form pinched portions of the ribbon cable on at least one side of the ribbon cable.

* * * * *